US010383361B2

(12) United States Patent
Mehio

(10) Patent No.: US 10,383,361 B2
(45) Date of Patent: Aug. 20, 2019

(54) HOOKAH

(71) Applicant: Mya Saray, LLC, Sterling, VA (US)

(72) Inventor: Nizar Youssef Mehio, Tallet El Khayet (LB)

(73) Assignee: Mya Saray, LLC, Sterling, VA (US)

( * ) Notice: Subject to any disclaimer, the term of this patent is extended or adjusted under 35 U.S.C. 154(b) by 611 days.

(21) Appl. No.: 15/063,503

(22) Filed: Mar. 7, 2016

(65) Prior Publication Data

US 2017/0251717 A1 Sep. 7, 2017

(51) Int. Cl.
*A24F 1/30* (2006.01)

(52) U.S. Cl.
CPC ..... *A24F 1/30* (2013.01)

(58) Field of Classification Search
None
See application file for complete search history.

(56) References Cited

U.S. PATENT DOCUMENTS 3,918,464 A 11/1975 Kolodziej
2006/0272657 A1 12/2006 Mehio
2006/0272658 A1* 12/2006 Mehio ..... A24F 1/30 131/173

* cited by examiner

*Primary Examiner* — Michael J Felton
*Assistant Examiner* — Katherine A Will
(74) *Attorney, Agent, or Firm* — Da Vinci's Notebook, LLC

(57) ABSTRACT

A hookah and method for smoking a hookah are disclosed that permit more effective purging of "stale" wetted tobacco smoke from a hookah. The hookah includes a stem, bottle, and check valve in fluid communication with a dry smoke inlet of hookah. The valve is located in a 'low' position within the hookah for more effective use of positive pressure within the hookah for purging. The method includes purging wetted tobacco smoke through a valve that selectively leads to the dry smoke conduit.

19 Claims, 10 Drawing Sheets

HOOKAH

FIELD OF THE INVENTION

The present invention relates to the field of tobacco smoking and more specifically to the field of hookah smoking.

BACKGROUND

Of the many proud traditions of Ottoman culture, few have achieved the world-wide fame of hookah smoking. Once confined to the Middle East and Near East regions, the hookah's notoriety was invigorated by Napoleon's invasion of Egypt and the stream of curious Westerners which followed thereafter. Painters, such as Eugene Delacroix and Jean-Leon Gerome, when depicting Oriental styles typically included a hookah as a symbol of the depicted culture. The hookah was elevated from a regional curiosity to a universal symbol of sophistication.

The hookah, which has maintained a constant popularity in the Middle East, presently enjoys in American culture a unique, niched function. Hookah smoking combines community and relaxation into a single event. Rarely does one witness a group smokers crowded about a single cigarette, cigar, or pipe. Though hookahs are often designed with a single smoke outlet; the presence of multiple hoses, each capable of simultaneous use, emanating from a single smoking instrument is unique to the hookah. Multiple hose hookahs form the centerpieces of hookah clubs in which hookah smokers gather to unwind and converse with other community members. A hookah combines fashion, art, and function into a single device.

A basic hookah includes a bottle, a stem, at least one hose with a mouthpiece, and a burner. The hookah burner holds the hookah tobacco, frequently "massell." Massell is a mixture of tobacco, molasses, and often a flavor or fruit extract. The molasses and fruit extract add a substantial amount of moisture to the massell that is missing in conventional tobacco. This added moisture makes massell more sensitive to the elements relative to conventional tobacco; prolonged exposure to air evaporates much of the moisture of massell and reduces its flavor. When properly protected, massell allows a smoker a more recreational, flavored smoke than the tobacco of cigars, cigarettes, pipes, and the like. An experienced hookah smoker will know to loosely distribute massell into a pile within the hookah burner to allow heat to evenly circulate through the pile.

The heat that ignites the massell derives from coals positioned above the hookah burner. The coals and massell preferably never contact one to the other. A common method of placing coals proximate to the massell involves spreading a foil upon the top of a hookah burner, punching holes in the foil, and then placing the coals onto the foil. The heat from the lighted coals travels through the holes in the foil to ignite portions of the massell. Particulates from the massell travel in the smoke created by the ignition down through the hookah burner into the hookah pipe.

The hookah stem is the smoke transport component of a hookah and is usually fabricated from brass, tin, or stainless steel. The stem transports the massell smoke from the burner to the hookah bottle, which is a cavern containing water. The bottle of the hookah is typically fabricated of glass or plastic and tends to be the most expressive portion of the hookah, ranging from translucent to wildly-colored. Within the cavern of the hookah bottle, the massell smoke is cooled by the water within. The cooled massell smoke then returns to the stem, though not through the same entrance by which the massell smoke enters the bottle. From the stem, the massell smoke travels through the hose and out of the mouthpiece.

There are presently two prominent versions of hookah structures: the Lebanese style and the Egyptian style. Although the aficionado will explain that there are many differences between the two styles, the practical layman would quickly note the obvious difference: the connection point between the stem and the hookah burner. The Egyptian style hookah pipe tapers upward into what is generally referred to as a male connection. The Egyptian style hookah burner includes a female connection which receives the pipe's male connection. In the Lebanese style hookah the burner has the tapered male connection and the pipe has the female connection to accept the Lebanese style hookah burner. In both styles, to allow a more airtight connection a collar is generally added to fit around the male connection.

Although hookahs are growing more advanced, there are still troubles common to hookahs. One of the greatest impediments to hookah smoking enjoyment is the problem of aggregated, stale wetted smoke. The stale, wetted smoke sits in the path of fresh smoke, the density frustrating the internal gas flow dynamics of the hookah and the taste of the wetted smoke corroding the fresh smoke as it passes through the stale cloud. The present invention goes a long way towards solving this lingering, troublesome issue.

SUMMARY

The present invention is directed to a hookah. The hookah includes a hookah bottle and hookah stem. The hookah stem includes a primary stem, which further includes a plenum and a burner support. The bottle holds liquid for cooling wet smoke and has a bottle interior and a bottle neck.

The primary stem, positioned above said bottle neck, is adapted to hold a hookah burner. The interior of the stem includes a central, substantially-vertical dry smoke conduit bounded by a dry smoke inlet and a lower dry smoke outlet formed by a transverse stem wall. A wet smoke conduit bounded by a wet smoke inlet and a peripheral wet smoke outlet is positioned above the bottle neck. The hookah stem further includes a down tube, affixed to the dry smoke outlet and further defines the dry smoke conduit. The down tube terminates in a lower dry smoke release aperture and forms a peripheral wet smoke intake. The down tube is dimensioned to extend into the hookah bottle to a penetration depth at least half of a bottle's height.

The stem further includes a pressure-actuated check valve, co-planar to the bottle and in gaseous communication with the dry smoke conduit of the stem. A wet smoke entry is exposed to the bottle interior and adapted to be selectively impeded, during neutral and negative bottle pressure events, and allow, during positive bottle pressure events, gaseous communication from the wet smoke entry to the wet smoke intake. A hose fitting, affixed to the wet smoke outlet, permits the releasable affixation of a hookah hose to the hookah stem.

The present invention further includes a method for smoking a hookah. The method includes downwardly drawing indirectly-combusted tobacco smoke from a hookah burner into an elongate dry smoke conduit of the hookah stem into a liquid within the interior of a hookah bottle using the hookah hose releasably affixed to, and in gaseous communication with a wet smoke conduit of, the hookah stem. Then one aggregates a substantial amount of wetted tobacco smoke within the hookah bottle above the liquid and below the transverse wall of the hookah stem. Then one urges air from the hookah hose through the wet smoke smoke conduit into the bottle interior to create positive bottle pressure. Wetted tobacco smoke is directed into the pressure-actuated check valve, co-planar with said bottle and in gaseous communication with the dry smoke conduit of the stem, with a wet smoke entry exposed to the bottle interior and adapted to selectively impede, during neutral and negative bottle pressure events, and allow, during positive bottle pressure events, gaseous communication from the wet smoke entry to the wet smoke intake. Wetted tobacco smoke is directed upwardly through the dry smoke conduit toward and through the hookah burner.

These aspects of the invention are not meant to be exclusive. Furthermore, some features may apply to certain versions of the invention, but not others. Other features, aspects, and advantages of the present invention will be readily apparent to those of ordinary skill in the art when read in conjunction with the following description, and accompanying drawings.

DETAILED DESCRIPTION

Figure 1:
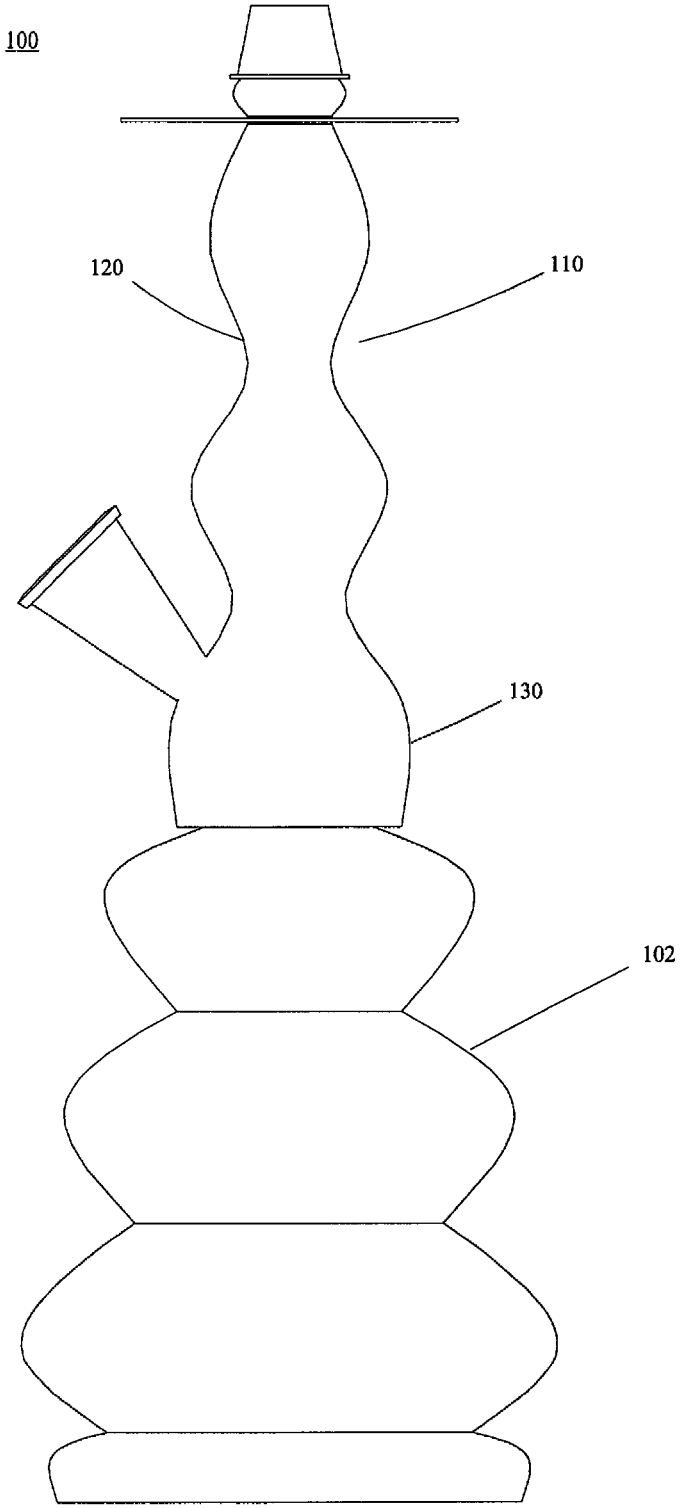
FIG. 1 is a side isometric view of the hookah of the present invention.
Figure 2:
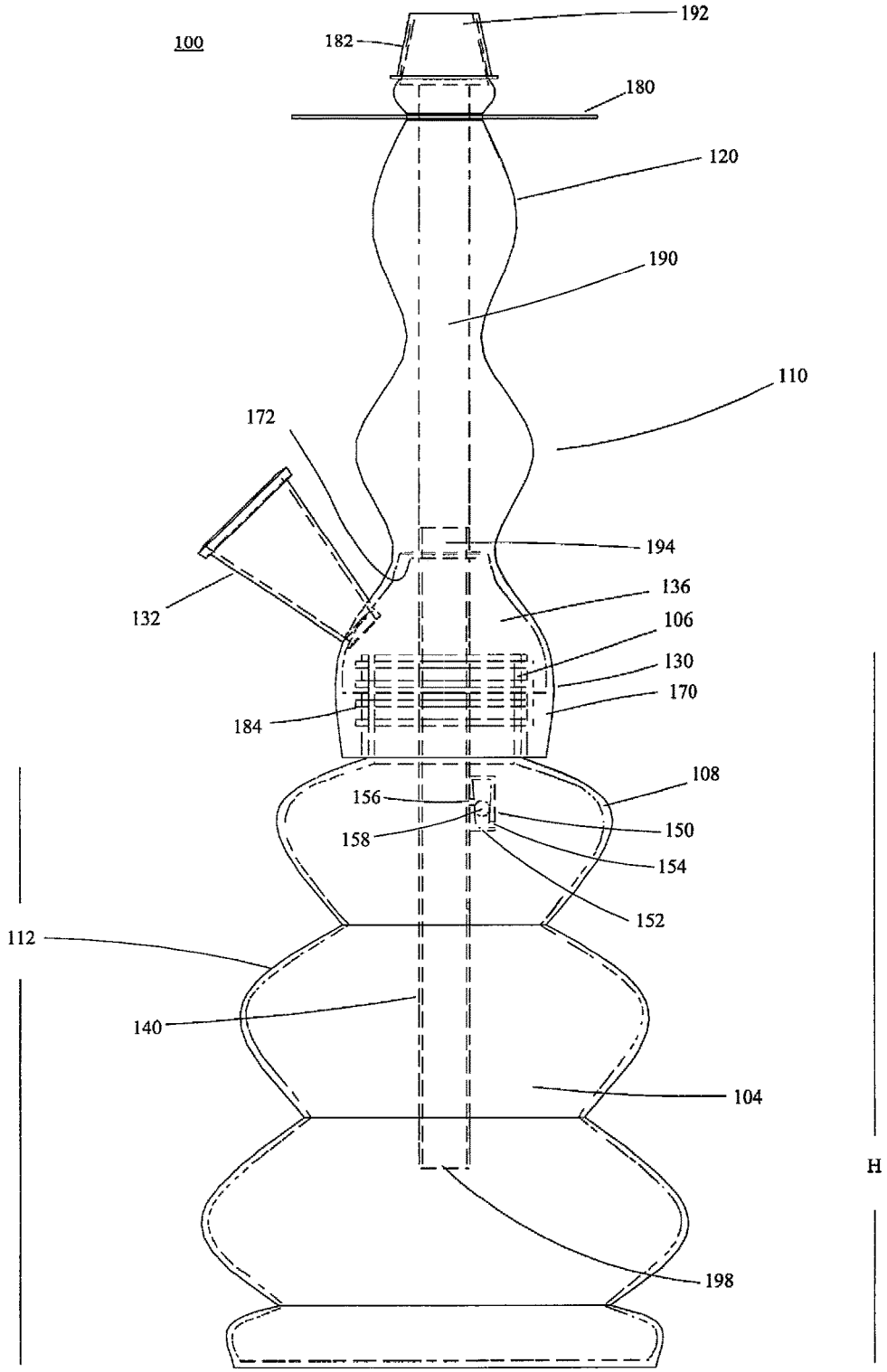
FIG. 2 is a side, exposed isometric view of the hookah of the present invention.
Figure 3:
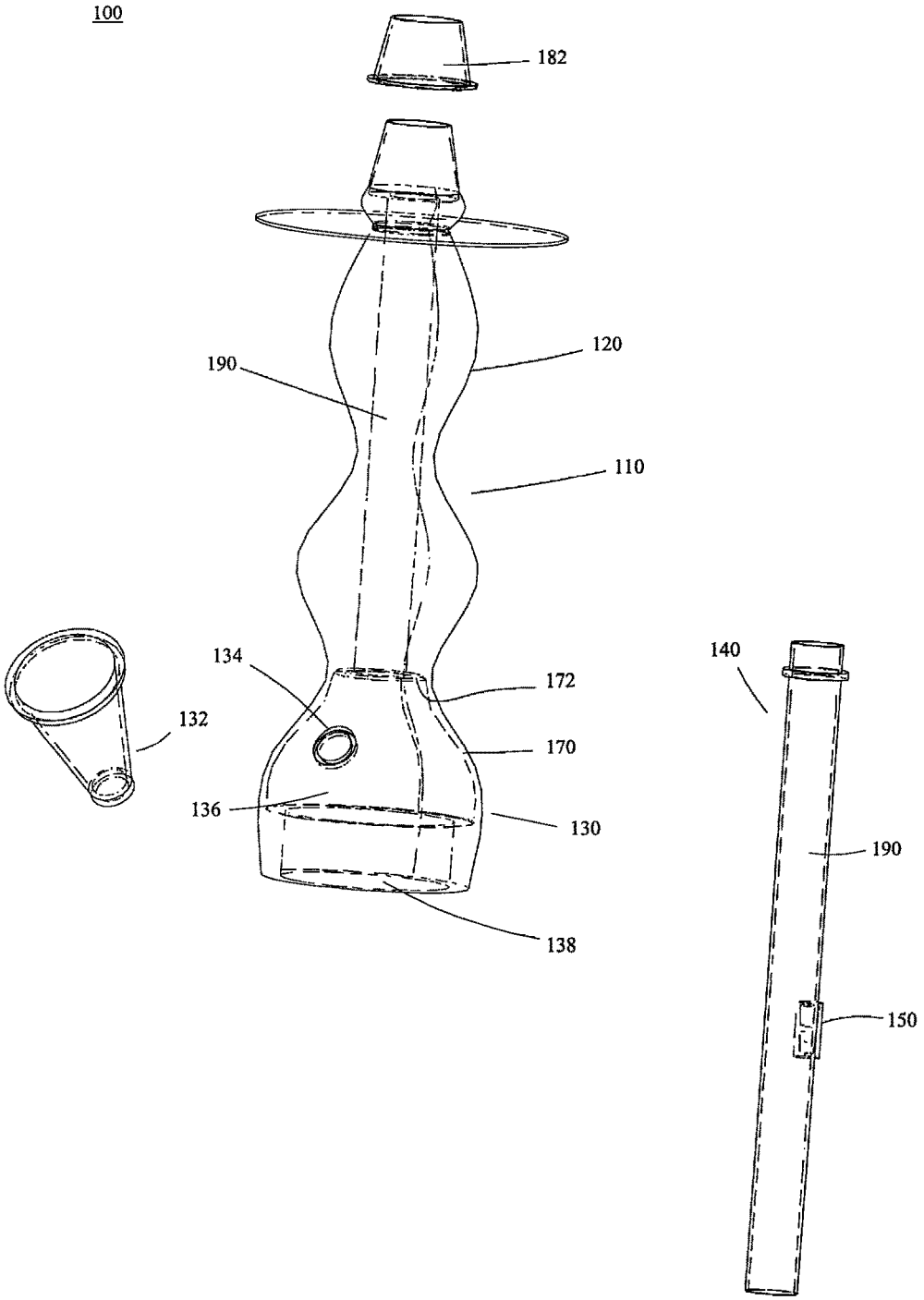
FIG. 3 is an upper, exposed isometric view of the stem components of the present invention.

Referring first to FIGS. 1-3, a basic embodiment of the hookah 100 of the present invention is shown. The hookah includes a stem 110 and a bottle 102. The bottle 102 can be conceptually subdivided into at least two regions for the purposes of the present disclosure, an interior 104 and a neck 106. The bottle 102 may be constructed of any material commonly used in the fabrication of hookah bottles, and the bottle may feature a generally unlimited series of shapes and dimensions. The bottle 102 includes a solid sidewall 108 that holds liquid (not shown) for the cooling of tobacco smoke. The bottle 102 is generally bulbous for the retention of a substantial amount of water. The neck 106 of the present invention is the portion of the bottle upon which a stem is usually attached, either internally or externally and begins at the apex of the bottle and continues until the point at which the bottle flares into the bulbous portion of the bottle, the hookah body 112. The bottle interior 104 includes the volume of the hookah bottle bounded by the hookah sidewall, and it should be noted that there is not necessarily a clear boundary of a hookah "neck." For purposes of the present disclosure, the hookah neck spans from the apex of the hookah bottle, to the lower of: the point of the hookah bottle wherein the bottle first begins to flare outward (to increase the volume and lower the center of mass for the stability necessary to support the hookah mass), or the point below where the stem affixes to the hookah bottle in a manner that forms an airtight seal between the stem and neck. In the hookah of FIG. 1, for example the apex of the hookah is the point where stem and bottle form an airtight seal, but because the bottle begins to flare outward just adjacent to the lower point of the primary stem. The bottle and the stem of a hookah are separable, and in the embodiment of FIG. 1 join via an interference fit through the use of a compressible seal 184.

The stem 110 can be conceptually subdivided into three components, the burner support 120 and plenum 130 (together which form the "primary" stem), and a down tube 140, which supplements the dry smoke conduit 190 of the primary stem. The burner support 120 and a stem plenum 130 may, or may not, be separable as described in U.S. Pat. No. 7,806,123, the disclosure of which hereby incorporated into the present disclosure. Generally speaking, the burner support 120 is discernable from the stem plenum 130 by function; the burner support generally contains only dry smoke that is transported from the hookah burner downward, while the plenum 130 includes complex airflow passages for the shunting of both wet smoke and dry smoke to their respective destinations. Again, the use of terminology such as "plenum" and "burner support" is not to imply that the features are clearly distinct one from the other, or that the components are separable; instead, such terms are descriptive supports to aid in explaining the present invention. The burner support holds a hookah burner/bowl, or such other arbitrary components that further extend the height of the hookah having a dry smoke conduit and a position for the burner. The hookah of FIGS. 1-3 has a compressible seal 182 for the interference fit affixation of a burner to the burner support, as well as a shield 180 for the deflection/collection of ashes away from the hookah body. The stem plenum includes one or more wet smoke apertures 132, shown here as a hose fitting, which as described in U.S. Pat. No. 8,001,978 (the disclosure of which hereby incorporated into the present disclosure), may be for the purpose of drawing smoke to a user (e.g., a hose fitting) or wet smoke pressure release. Hose fittings 132 may be releasably affixed to the stem plenum 130, preferably by means of mating threading on an end of the hose fitting and the wet smoke outlet 134 of the plenum 130. The purpose of the hose fitting is to releasably affix a hookah hose thereto. Although a hookah hose is a significant component of the hookah, for purposes of the present invention, the hose need not be considered other than that it is a source of positive or negative gaseous flow into the hose fitting and plenum. Therefore, a hookah hose need not be detailed to understand the present invention.

The hookah bottle 102 includes a solid sidewall because unlike other smoking instruments, which lack an ornamental nature, the stem contains the necessary airflow elements. The hookah bottle 102 has an opening bounded by the neck 106 for the stem 110 to send and receive smoke. The stem attaches to the hookah bottle through any means known in the art, including seal, threading, clasps, etc; and may attach at any position known in the art, such as within a hookah bottle neck, outside the hookah bottle neck, or atop the hookah bottle neck.

Dry smoke begins at the burner (not shown), enters the dry smoke inlet 192 and travels through the dry smoke conduit 190 of the burner support 120. From the burner support 120, dry smoke enters the stem plenum 130 where it may or may not be immediately directed to the down tube 140. In any case, the dry smoke enters the stem plenum 130 through a channel that further forms the dry smoke conduit 190. In the hookah embodiment of FIG. 3, for example, the plenum lacks internal channeling that defines the dry smoke conduit; instead, the dry smoke conduit is further formed by the down tube 140. The dry smoke conduit in most hookahs is effectively formed of two components: the burner support 120 and the down tube 190, the latter of which shunts dry smoke through the plenum with an interior ostensibly entirely dedicated to the acceptance of wet smoke rising from the bottle, an elevated wet smoke cavern. The hookah embodiment of FIG. 3 can be contrasted with the hookah embodiment of FIG. 4, which includes a plenum with internal channeling defining both dry smoke conduit 190 and wet smoke conduit 136. Sidewalls 170 of the hookah of FIG. 3 "contain" or "have" the dry smoke conduit, whereas the sidewalls 170 of the hookah of FIG. 4 define the wet smoke conduit 136 (as an elevated wet smoke cavern) and dry smoke conduit 190. The present invention may be used with either type of hookah, or some other variety.

It is preferred in the present invention that the down tube 140 include an attachment means, e.g. threading, pressure-fit, clasp, etc., for attaching the down tube to the dry smoke outlet 196 primary stem. By dry smoke outlet 196 it is meant the aperture through which dry smoke exits the primary stem for its descent into the hookah bottle 102. Placing a down tube 140 at the apex of the plenum 130, as shown in FIG. 3, permits greater variations in, and simplified, wet smoke channeling within the base stem with less materials removal therein during fabrication. Returning to FIGS. 1-3, the dry smoke travels through the down tube 140 into the hookah bottle 102 as it exits the down tube dry smoke release 198; and in the presently discussed embodiment, the dry smoke is segregated from the wet smoke conduit by transport through the down tube within the plenum 130.

Figure 4:
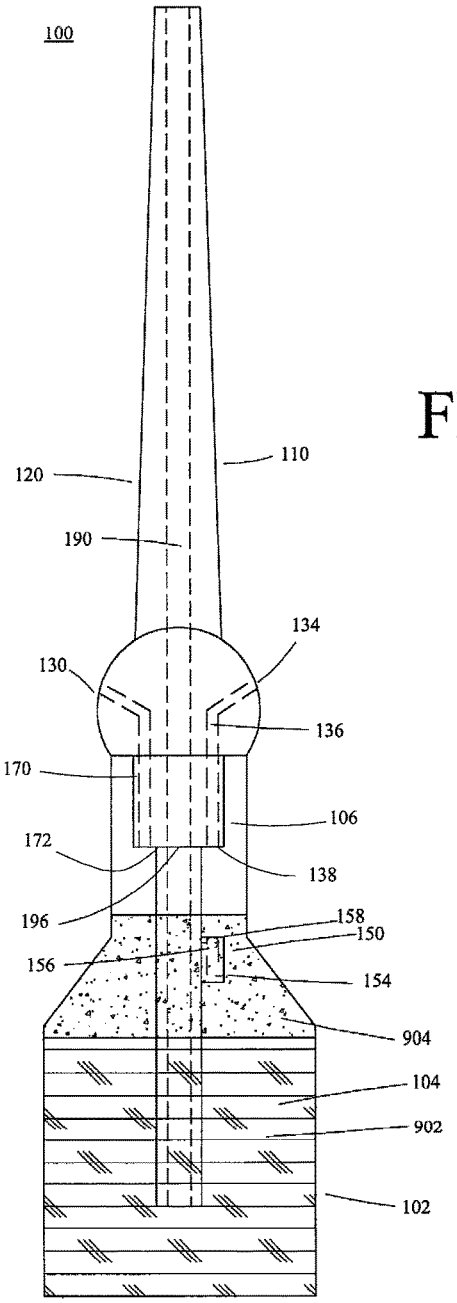
FIG. 4 is a side, exposed orthographic view of a hookah of the present invention.

As shown in FIG. 4, when the dry smoke is released from the down tube 140 into the hookah bottle 102, the liquid 902 cools the smoke. The smoke ascends through the liquid 902 and is released above the surface of the liquid to become wetted smoke 904 in the bottle interior. The wetted smoke ascends from the bottle interior into the stem base so long as there is negative pressure in the hookah bottle interior, relative to the dry smoke conduit. By negative pressure (with reference to the bottle interior), it is meant pressure less than that of equilibrium. During negative pressure events, gas is drawn from the interior of the hookah bottle to the plenum and out the hose fitting through the wet smoke conduit. Hookah smoking is a negative pressure event. By neutral pressure (with reference to the bottle interior), it is meant that the pressure of the hookah bottle interior is in substantial equilibrium with the dry smoke conduit. A user achieves a neutral pressure event by refraining from drawing gas from the hookah or blowing air into the hookah through the hose fitting. By positive pressure (with reference to the bottle interior), it is meant pressure greater than that of equilibrium, relative to the dry smoke conduit. During positive pressure events, gas is blown from the hose fitting through the wet smoke conduit to the interior of the hookah.

One of the great problems confronting hookahs, and their users, that is not shared by other smoking implements is the aggregation of stale, wetted smoke 904. Although the purpose of a hookah is to deliver wetted smoke to a user's mouth, smoke that spends a substantial length of time in the hookah interior without being drawn into the plenum becomes "harsh" and undesirable. Unfortunately, of the gases present in the hookah, wetted smoke is the densest—and therefor most challenging to move and/or expel. Therefore drawing a hookah with stale, aggregated wet smoke draws fresh smoke into the liquid, and then subsequently up into the plenum. However, the density of the stale smoke prevents a "first in, first out" scenario; instead, significant quantities of the newly-drawn smoke is likely to be drawn toward the user, and drawn through the stale smoke, into the plenum. A cloud of aggregated wet smoke creates a layer of undesirable gaseous tobacco that affects each draw of smoke that passes through it. Multiple solutions have been attempted to purge a hookah of the ultra-dense stale smoke.

For users of hookahs exemplified by the figures of U.S. Pat. No. 7,806,123, the disclosure of which is hereby incorporated by reference, the hookahs include no mechanical means of controlling pressure loss. The hookahs leaked unless manually stopped from doing so. Unfortunately, the denser the smoke, the less the likelihood that the smoke would simply dissipate upward through the hookah hose. Users tended to place a finger on the aperture of a hookah hose to prevent leakage anyway. To purge a hookah of stale smoke, one user would blow at a very calculated rate into the hookah hose to attempt to push the wetted hookah smoke from the bottle interior. This met with some success; however, because dry air from a human is less dense than wetted, tobacco smoke, gas that exited the hookah through an autoseal pressure gate was a mixture of human breath and wetted smoke, mostly the former. The blow rate was highly calculated because if not forceful enough, the wetted smoke would not be sufficiently urged to leave in significant quantity and the exiting gas would be composed highly disproportionately of human breath. If the user blew too forcefully, a portion of gas would exit the autoseal gate, but yet another portion would operate the hookah in reverse to compress the liquid in the bottle sending liquid up the dry smoke conduit and squirting water out through the hookah bowl—extinguishing the coals and ruining the tobacco.

Then the hookahs of the '978 patent appeared; although these hookahs solved the hookah leakage issues during neutral pressure events, the solution for purging the interior of the hookah bottle remained the same. Further compounding the issue of purging a hookah is the myriad of internal dimensions of a hookah stem and bottle. During a state of equilibrium, wetted smoke behaves according to the principles of Brownian motion and will achieve a generally uniform Brownian distribution within the stem base interior. During states of positive pressure (e.g., blowing into the stem base) and negative pressure (e.g., sucking from the stem base), the pressurized wetted smoke behaves according to the principles of Bernoulli and the Continuity Equation. Wherein ρ is fluid density, A is cross section area, v is velocity, and time is time:

$$P(A1)v1(\Delta t)=\rho(A2)v2(\Delta t)$$

The entire volume of a hookah stem and hookah bottle capable of retaining wetted smoke is of consequence—although open volumes are of greater consequence than constricted volumes (e.g., wet smoke channels). The complex smoke shunting avenues of a hookah are located in the stem. Even the in the revolutionary '978 patent, the patent depicts a hookah having autoseal gates, either independent or combined into a hose fitting, that are located above where dense smoke would naturally aggregate. Wetted smoke aggregates around the surface of the liquid within a hookah bottle; whereas wetted smoke egress points tend to be in the lower portion of the stem. Gas blown into a hookah from a hose fitting starts at the entry point of the hose fitting, usually the periphery of the base of a stem; from there the gas travels throughout the open volumes of a hookah. Although there will almost always be a downward open volume from the hose fitting, often there is a significant upward open volume that may generate a spiraling downward force acting to nullify any upward force from the liquid surface. The force of gas in the direction of the liquid surface to the point of exit is the most consequential force in the purging process. The present invention offers two significant solutions: (i) the invention provides internal contouring that permits the efficient use of internal forces, and (ii) the invention changes the point of exit to a central position that is also co-planar to the bottle rather than a point high in the stem.

The present invention features a pressure-actuated check valve 150 preferably positioned co-planar to the bottle. In other words, the preferred check valve is located on the configured hookah of the present invention in a position whereby a horizontal line that intersects the check valve 150 would necessarily intersect the hookah bottle 102. A check valve is a backflow prevention device: it allows flow in only one direction. The pressure of forward fluid flow opens the valve and the pressure from backflow closes it, forcing the stopper, whether the stopper includes a gate, ball, wall, etc., against the valve seat. The preferred location for the check valve is affixed to exterior or interior of the down tube. The check valve may be integrated into the down tube; and in instances wherein the stem recedes well into the hookah neck, the check valve may be integrated into the stem. The check valve of FIG. 2 depicts a ball check valve. The ball check valve features a body 152 having a wet smoke entry 154 and a wet smoke intake 156. The body defines a frustoconical void wherein a floating spherical stopper 158 utilizes merely the force of gravity to form a one-way seal during negative pressure events within the bottle. During positive pressure events, gas travels from the wet smoke inlet 138 down the wet smoke conduit 136 and through the wet smoke inlet 138 and into the bottle interior. The pressure accumulation reaches the entry to the valve, the wet smoke entry 154, and urges the stopper 158 upward into the larger diameter of the void thereby permitting gaseous flow from the wet smoke entry 154 to the wet smoke intake 156. The wet smoke entry offers gaseous communication between the bottle interior and the valve; the wet smoke intake offer gaseous communication between the valve and the dry smoke conduit 190. The valve may directly access the dry smoke conduit 190 of the down tube 140 or the dry smoke conduit of the primary stem, depending on which location is most convenient and accessible.

A hookah is a unique smoking instrument in that there are multiple avenues of gas flow within the device, and there is a central gas collection point from which gas is distributed. The present invention exploits an avenue of gas transfer as a purge route not utilized by existing hookahs, the avenue by which dry smoke is delivered to the bottle. During a positive pressure event, the check valve 150 allows gas into the dry smoke conduit 190 and the pressure forces the gas up the dry smoke conduit, through the stem, and then out through the dry smoke inlet 192. From the dry smoke inlet 192, gas passes into the outside environment through the burner (not shown). So for the purposes of the present invention, certain conventional terms such as "dry smoke conduit" should be viewed in context to be understood. Conventional hookahs utilize a dry smoke conduit solely for the unidirectional delivery of dry smoke. The present invention alters this convention, and allows during select periods, wet smoke to enter the "dry smoke conduit" for purposes of purging the wetted smoke. Furthermore, directing wetted smoke into the usually narrower dry smoke conduit permits less force to be used to purge the wetted smoke. Wet smoke collecting in a narrow conduit is less troublesome than wetted smoke collecting in a larger volume because the wetted smoke is more easily urged from one direction to another. Wetted smoke not purged in the dry smoke inlet would settle as the lowest point of the down tube that remains above the liquid surface. Highly pressurized air from the dry smoke conduit may even force a substantial amount of wetted smoke back into the liquid.

Figure 8:
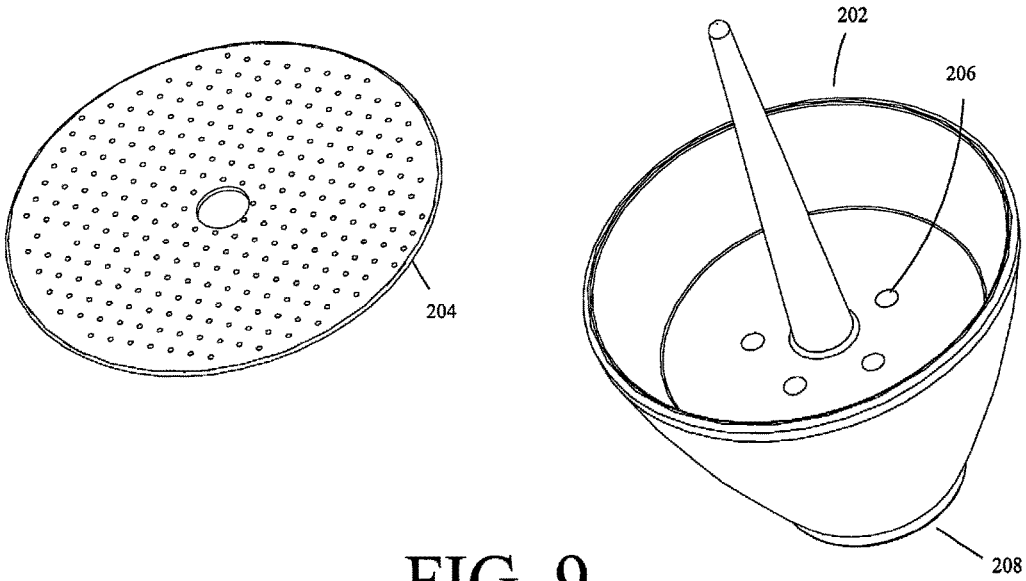
FIG. 8 is an upper, isometric view of a hookah bowl of the present invention.
Figure 9:
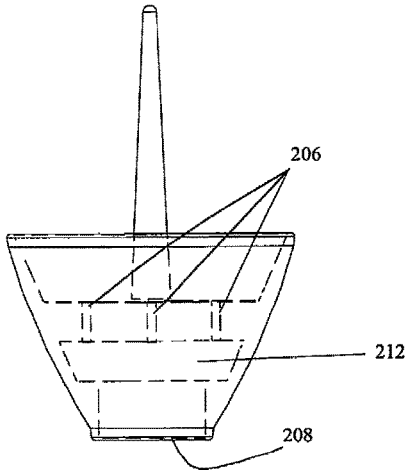
FIG. 9 is a side, exposed view of a hookah bowl of the present invention.

Another differentiating aspect of hookah smoking is the use of a specialized burner. Specifically, the burners utilized in connection with hookah stems have inherent structural intricacies that, although designed to prevent tobacco from falling into the hookah stem, happens to be an admirable structure for exhaust of smoke. Hookahs burners (also known as "bowls"), although varying from brand-to-brand, tend to have a number of similar features as shown in FIGS. 8-9. The hookah burner 202 as depicted includes the most common feature of hookah burners, a platform with multiple tobacco smoke apertures 206. Furthermore, the burners 202 often include a void 212 below the tobacco platform with a substantially greater diameter than the dry smoke inlet 190. The hookah burner depicted includes a spire that works in concert with a plate 204 for holding coals. Although such a burner is proprietary and rare, there is a parallel to be drawn with more conventional hookah burners that utilize a foil rather than a solid, perforated plate. Even hookah bowls that utilize a single aperture, which is usually raised to prevent tobacco from falling into the hookah stem, tend to utilize some manner of multi-punctured self-supporting sheet. Alternatively, as exemplified by U.S. Design Pat. No. 618,389, the disclosure of which is expressly incorporated into this application, the hookah bowl may include horizontal apertures. Whether the hookah burner possesses multiple vertical apertures, a sizable void, and/or one or more horizontal apertures, these features, when applied in reverse, act to disperse and/or muffle the force of purged gas being exhausted through an unconventional exit point.

Turning now to FIG. 4, the present invention also contemplates a plunging hookah stem 102. By plunging hookah stem it is meant that the hookah stem 102 includes a plenum 130 that defines the wet smoke conduit 136 and the dry smoke conduit 190. Such stems generally are less simple to discern between the plenum and the burner support, mostly because such distinctions are less useful in describing the internal features. Plunging hookah stems have certain disadvantages over stems with elevated wet smoke caverns because the wet smoke conduits must be created within the sidewall 170, usually with a boring instrument. These conduits are usually sinuous, meaning for the purposes of this disclosure, that they include at least one change of direction (i.e., are non-linear). The sidewalls 170 of hookahs with elevated wet smoke caverns, as shown in FIG. 2, permit direct, linear wet smoke conduits to be constructed. Both the hookah stem embodiments of FIGS. 2-4 feature a sidewall with a tranverse wall 172, simply located in different positions. By sidewall it is meant a barrier of the plenum with respect to the outside environment; by transverse wall it is meant a sidewall portion having a substantially horizontal portion to a degree that permits a down tube to be affixed thereto (for releasable down tubes), or extend therefrom (for unitary down tubes). The preferred down tube 140 releasably affixes to the dry smoke outlet 196; however, the down tube 140 can be integrated into the stem. The significant feature of the down tube is that it extends down into the hookah bottle 102 to distance equal to at least half of the hookah bottle's height H, and that the down tube is the point of the stem at which the stem, upon being approximately co-planar with the bottle, projects minimal mass into the hookah bottle. The stem serves several functions, including structural support and structural stabilization. As the portion of the stem that need not be a barrier against glancing blows (because it is within the bottle) nor affix to the bottle to provide stability, the down tube needs only the mass to continue to shunt dry smoke into the hookah bottle. The stem of FIG. 4 utilizes a ball check valve having a body 152 forming a void with an elevated ceiling. Upon encountering a positive pressure event, gas enters the wet smoke entry 154 the stopper 158 is urged upwards to a position above the wet smoke intake 158.

Figure 5B:
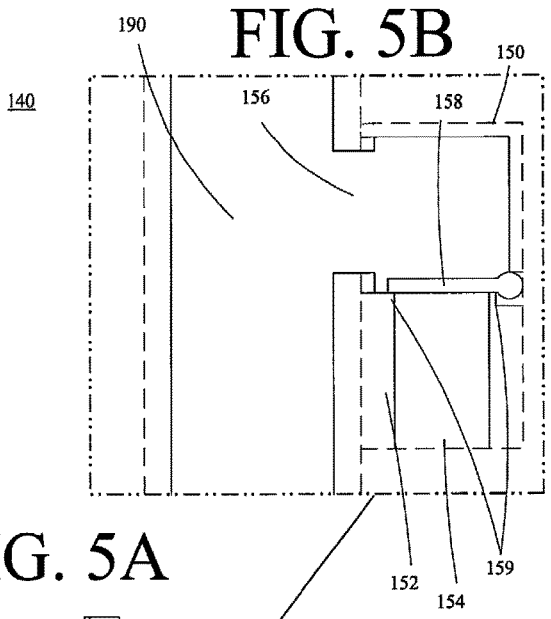
FIG. 5B is a side, detailed othagraphic view of a down tube and valve of the present invention.
Figure 5A:
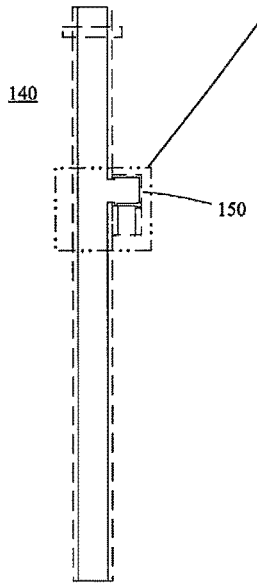
FIG. 5A is a side, exposed orthographic view of a down tube of the present invention.

Turning now to FIGS. 5A-5B, the down tube 140 may have affixed externally thereto the check valve 150. Another acceptable version of check valve includes a swing gate as an operative element 158. The body 152 of the check valve forms a central void and element shoulders 159. During negative and natural pressure events, a swing gate 158 is pressed or rests against, respectively, the element shoulders. During positive pressure events, gas enters the wet smoke entry 154 and urges the swing gate, which may or may not have a spring return, to and allow gaseous communication between the bottle interior and the dry smoke conduit through the wet smoke intake 156.

Figure 6A:
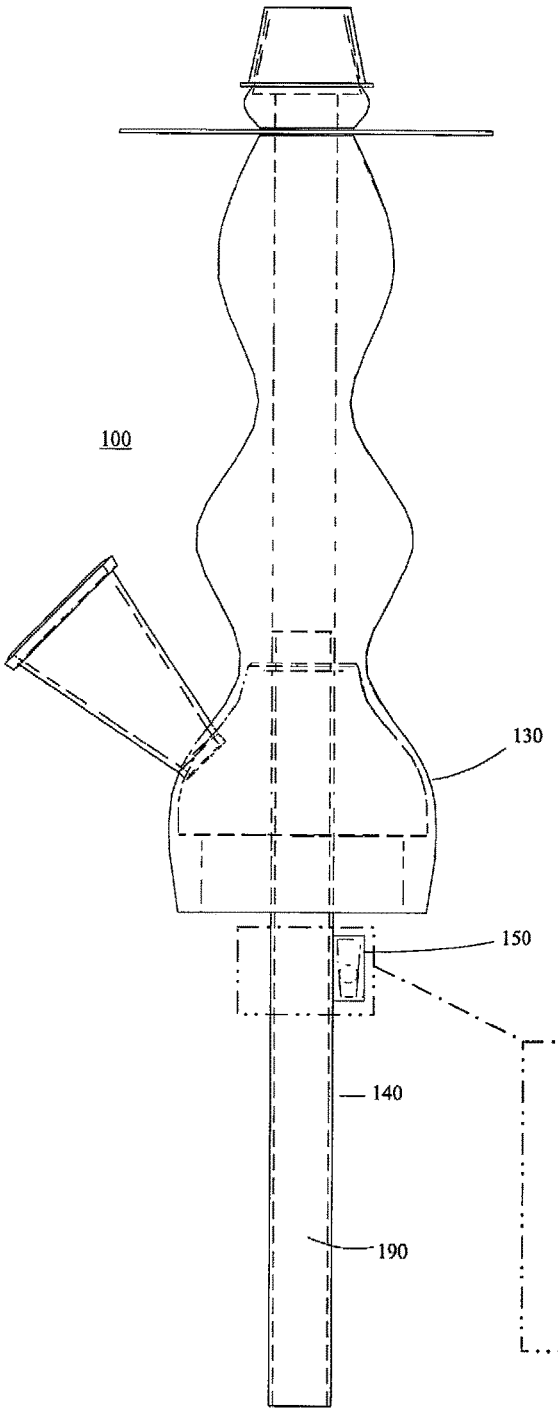
FIG. 6A is a side, exposed orthographic view of a stem of the present invention.
Figure 6B:
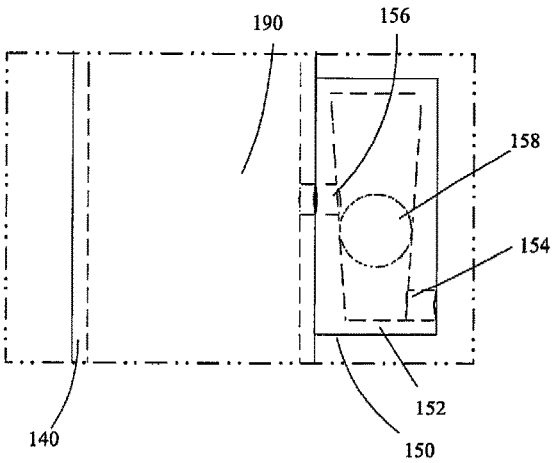
FIG. 6B is a side, detailed othagraphic view of a down tube and valve of the present invention.

FIGS. 6A and 6B depict the ball check valve 150, which may be externally affixed to the down tube 120. The body 152 of the check valve forms a central frustoconical void. During negative and natural pressure events, the spherical stopper 158 is pressed or rests against, respectively, the narrower portion of the void. During positive pressure events, gas enters the wet smoke entry 154 and urges stopper upward and allow gaseous communication between the bottle interior and the dry smoke conduit 190 through the wet smoke intake 156.

Figure 7B:
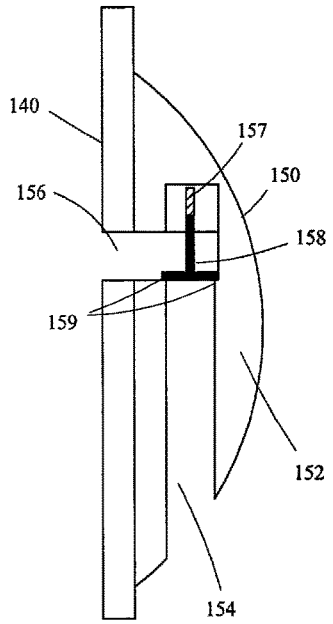
FIG. 7B is a side, exposed view of a down tube and valve of the present invention.
Figure 7A:
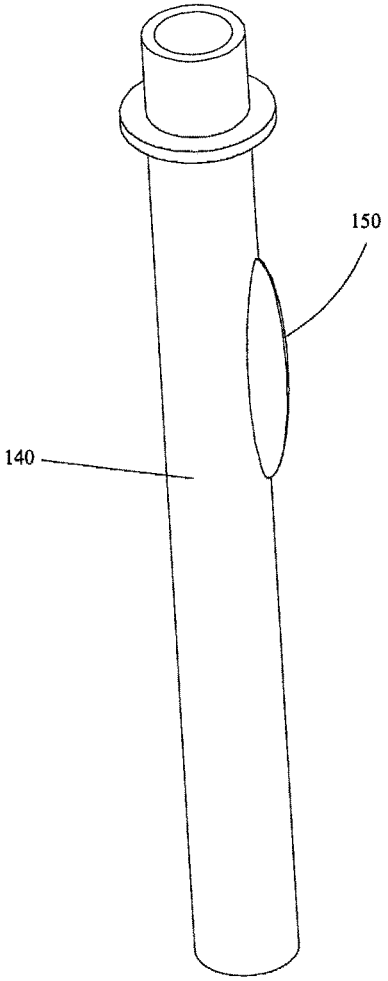
FIG. 7A is an upper, isometric view of a down tube of the present invention.
Figure 7C:
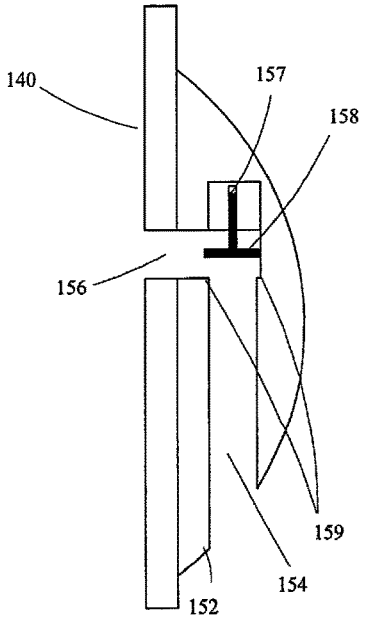
FIG. 7C is a side, exposed view of a down tube and valve of the present invention.

FIGS. 7A-7C depicts a check valve 150 integrated into the down tube 120. Down tubes are inherently low-mass structures and by nature lack the volume in which to embed a valve. The preferred means of integrating a valve into a down tube is by increasing the mass by use of raised blisters into which the valve is embedded. The check valve 150 version depicted in FIGS. 7A-7C is a lift check valve. The body 152 of the check valve forms a central void and element shoulders 159. During negative and natural pressure events, a lift gate 158 is pressed or rests against, respectively, the element shoulders. During positive pressure events, gas enters the wet smoke entry 154 and urges the lift gate, which may or may not have a spring return, into a lift gate void 157 to and allow gaseous communication between the bottle interior and the dry smoke conduit through the wet smoke intake 156 The check valve of the present invention may interact with the stem of the present invention in order to perform its task; the attachment to a down tube, for example, may be external, integrated, or internal. It is preferred that the attachment is external, or integrated if easily accessible, because the valves may require cleaning from time to time.

The particular version of the check valve utilized with the present invention is not an overriding factor. Other forms of valves that permit one-way gaseous communication capable of achieving the purposes of the present invention may be freely utilized. The position of the check valve 150 is a significant factor of the present invention, the closer that the valve can be positioned to the surface level of liquid within a hookah bottle, the better. Unfortunately, a product supplier does not control the amount of liquid that a hookah user places within the hookah bottle. A product supplier may, however, provide visual cues as to the appropriate height of a liquid. These visual cues may be placed on the bottle exterior or may be based on the lowest surface of the valve or provided on the down tube.

Figure 10A:
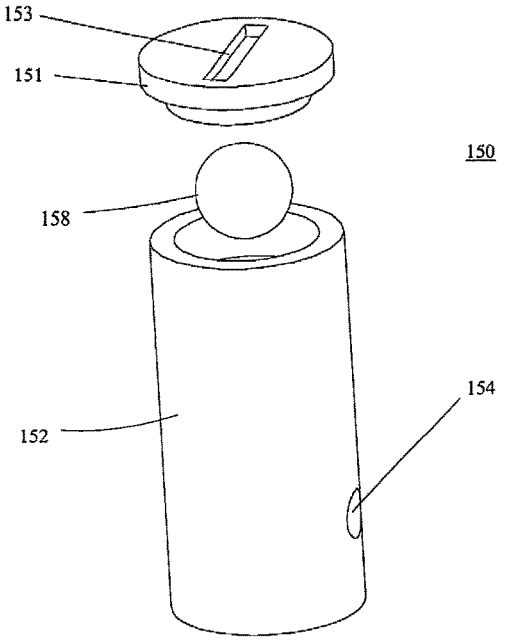
FIG. 10A is an upper isometric view of a valve of the present invention.
Figure 10B:
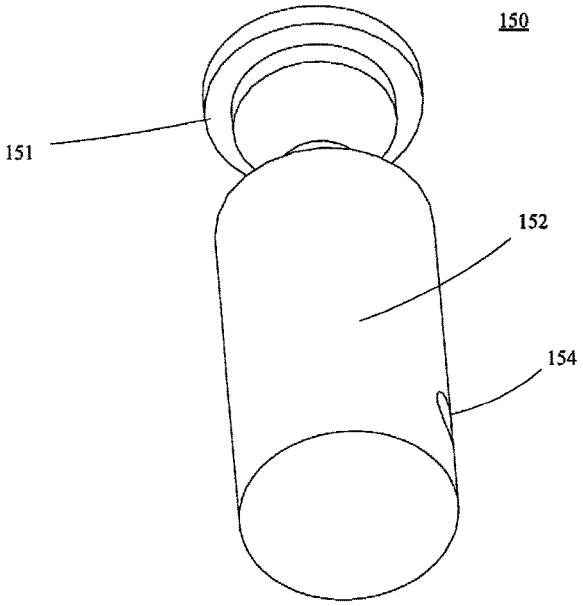
FIG. 10B is a lower isometric view of a valve of the present invention.

Turning now to FIGS. 10A-B, a preferred version of the check valve 150 includes a clean out means. By clean out means, it is meant a way of accessing the internal structures of the valve. An example of a clean out means includes a valve having a bifurcated body 152 such that a portion of the body is removable therefrom. The valve may include a valve lid 151 and removal means 153, such as a slit for a screwdriver or coin. The lid 151 may be affixed to the body 152 through any common attachment mechanisms such as interference fitting, threading, pressure fit, etc. The lid may be located, when a ball valve having a frustoconical void is used, towards the major diameter of the valve void such that the spherical stopper may be removed that the void formed by the body 152. Massell smoke is not only corrosive, but it is also highly adherent. Periodic soaking of the spherical stopper in a specialized solvent aids the invention in having a lengthy lifespan.

Figure 11A:
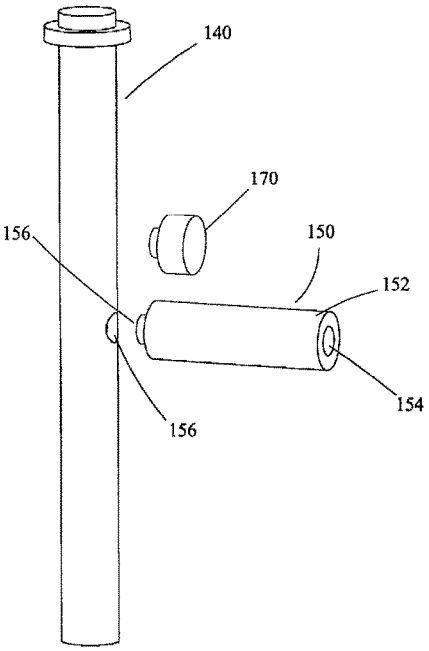
FIG. 11A is a side isometric view of a down tube, valve, and plug of the present invention.
Figure 11B:
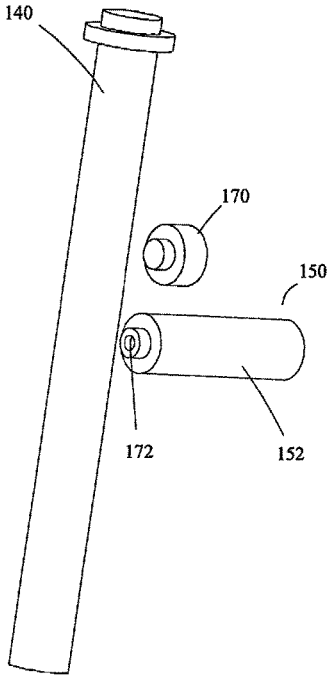
FIG. 11B is a side isometric view of a down tube, valve, and plug of the present invention.
Figure 12:
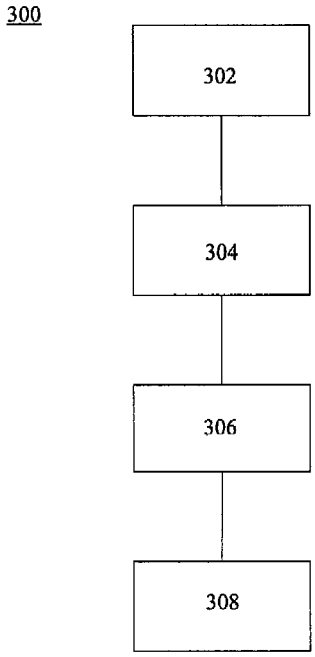
FIG. 12 is a view of the method of the present invention.

Turning now to FIGS. 11A-B, the present invention may utilize a check valve 150 that is removably affixed to a down tube 140. There may be situation wherein the valve is not desired to be used, or the valves may be interchangeable based on circumstances. In the valve version shown, because the down tube 140 extends vertically into the base of a hookah bowl and the valve extends roughly perpendicular therefrom, the use of a gravity-based valve is a non-preferred option. Instead a valve 150 that accommodates a roughly horizontal airflow from the wet smoke entry 154 to a wet smoke egress point of the valve, shown here as a wet smoke exit 172, and then into the wet smoke intake 172, preferably utilizes a swing gate valve (as shown in FIGS. 5A-B). The body 152 of the valve 150 releasably affixes to the down tube via the wet smoke intake. The body of the valve adjacent to the wet smoke exit 172 may be threaded to mate with threading on the wet smoke intake 156. Again, any affixation mechanisms known in the art may be utilized to join the valve to the down tube, including press fit and interference fit. Furthermore, the present invention may feature a down tube plug 170. The down tube plug 170 is an impediment adapted to fit into the wet smoke intake 156 when a valve does not occupy the wet smoke intake. The wet smoke intake may include any of the affixation mechanisms of the valve, and preferably utilizes whatever affixation mechanism is utilized by the valve body 152. As with the previously discussed lid, the body of the valve and plug may include a removal means, such as a cavity dimensioned to accept a screwdriver bit.

The invention further includes a method for smoking 300 a hookah. The method includes downwardly drawing 302 indirectly-combusted tobacco smoke from a hookah burner into an elongate dry smoke conduit of the hookah stem into a liquid within the interior of a hookah bottle using the hookah hose releasably affixed to, and in gaseous communication with a wet smoke conduit of, the hookah stem. Then one aggregates 304 a substantial amount of wetted tobacco smoke within the hookah bottle above the liquid and below the transverse wall of the hookah stem. Then one urges 306 air from the hookah hose through the wet smoke smoke conduit into the bottle interior to create positive bottle pressure. Wetted tobacco smoke is directed 308 into the pressure-actuated check valve, co-planar with said bottle and in gaseous communication with the dry smoke conduit of the stem, with a wet smoke entry exposed to the bottle interior and adapted to selectively impede, during neutral and negative bottle pressure events, and allow, during positive bottle pressure events, gaseous communication from the wet smoke entry to the wet smoke intake. Wetted tobacco smoke is directed 308 upwardly through the dry smoke conduit toward and through the hookah burner.

INDUSTRIAL APPLICABILITY

The present invention allows a user to enjoy hookah smoking by providing an efficient means of purging the hookah of stale, wetted smoke. A hookah may be used in a sealed state longer, and with greater effectiveness, prior to disassembly. The flavors of the tobacco product used with the hookah are less likely to be adversely affected by lingering wetted smoke.

Although the present invention has been described in considerable detail with reference to certain preferred versions thereof, other versions would be readily apparent to those of ordinary skill in the art. Therefore, the spirit and scope of the appended claims should not be limited to the description of the preferred versions contained herein.

What is claimed is:

1. A hookah comprising:

a hookah bottle having a solid sidewall defining a bottle interior and a bottle neck;

a hookah stem releasably affixable to said hookah bottle, said stem comprising:

a primary stem, positioned above said bottle neck, adapted to hold a hookah burner and having: a central, substantially-vertical dry smoke conduit bounded by a dry smoke inlet and a lower dry smoke outlet formed by a transverse stem wall; and a wet smoke conduit bounded by a wet smoke inlet and a peripheral wet smoke outlet above said bottle neck;

a down tube, affixed to said dry smoke outlet and further defining said dry smoke conduit, terminating in a lower dry smoke release aperture and forming a peripheral wet smoke intake, dimensioned to extend into said hookah bottle to a penetration depth at least half of a bottle height;

a pressure-actuated check valve, exteriorly affixed to said down tube and co-planar to said bottle and in gaseous communication with said dry smoke conduit of said down tube, with a wet smoke entry exposed to said bottle interior and adapted to selectively impede, during neutral and negative bottle pressure events, and allow, during positive bottle pressure events, gaseous communication from said wet smoke entry to said wet smoke intake; and a hose fitting, affixed to said wet smoke outlet, for the releasable affixation of a hookah hose to said hookah stem.

2. The hookah of claim 1 wherein said check valve includes a manually-removable valve aperture granting interior access to said check valve.

3. The hookah of claim 1 wherein said check valve is integrated with said down tube.

4. The hookah of claim 3 wherein said check valve includes a manually-removable valve aperture granting interior access to said check valve.

5. The hookah of claim 1 wherein said check valve is releasably attached to said down tube.

6. The hookah of claim 5 wherein said check valve includes a manually-removable valve aperture granting interior access to said check valve.

7. The hookah of claim 1 wherein said down tube is releasably affixed to said dry smoke outlet.

8. The hookah of claim 1 wherein said hookah primary stem includes: a burner support, adapted to hold said hookah burner, defining said substantially vertical dry smoke conduit; and a plenum having said dry smoke conduit and a sidewall having both said wet smoke outlet and said dry smoke outlet within said bottle.

9. The hookah of claim 8 wherein said plenum sidewall extends into said bottle neck and includes a transverse sidewall that defines said wet smoke conduit as a sinuous wet smoke conduit and further defines said dry smoke conduit.

10. The hookah of claim 9 wherein said burner support is removably affixed to said plenum.

11. The hookah of claim 8 wherein said plenum sidewall includes a transverse sidewall situated entirely above said bottle neck to create an elevated wet smoke cavern and that defines said wet smoke conduit as a linear wet smoke conduit.

12. The hookah of claim 11 wherein said burner support is removably affixed to said plenum.

13. A hookah comprising:

a hookah bottle having a solid sidewall defining a bottle neck, a substantially bulbous body, and a bottle interior; and a hookah stem releasably affixable to said hookah bottle and adapted to hold a hookah burner, having a central, substantially-vertical dry smoke conduit descending within said hookah bottle below said bottle neck, and terminating in a lower dry smoke release aperture and forming a wet smoke intake allowing peripheral access to said dry smoke conduit, and a wet smoke conduit, segregated from said dry smoke conduit, positioned to permit wetted smoke from said bottle interior to ascend therein and having a wet smoke outlet on a periphery of said stem, for the release of wetted smoke beyond said hookah stem, above said bottle neck;

a pressure-actuated check valve, united with said stem and positioned entirely below said wet smoke conduit, in gaseous communication with said dry smoke conduit, said valve having a wet smoke entry exposed to said bottle interior and adapted to selectively impede, during neutral and negative bottle pressure events, and allow, during positive bottle pressure events, gaseous communication from said wet smoke entry to said wet smoke intake.

14. The hookah of claim 13 wherein said check valve is exteriorly affixed to said hookah stem.

15. The hookah of claim 14 wherein said check valve includes a manually-removable valve aperture granting interior access to said check valve.

16. The hookah of claim 13 wherein said check valve is integrated with said hookah stem.

17. The hookah of claim 16 wherein said check valve includes a manually-removable valve aperture granting interior access to said check valve.

18. The hookah of claim 17 wherein said check valve is releasably attached to said hookah stem.

19. A method of smoking a hookah, said method comprising:

downwardly drawing indirectly-combusted tobacco smoke from a hookah burner into an elongate dry smoke conduit of a hookah stem into a liquid within an interior of a hookah bottle using a hookah hose releasably affixed to, and in gaseous communication with a wet smoke conduit of, said hookah stem;

aggregating a substantial amount of wetted tobacco smoke within said hookah bottle above said liquid and below a transverse wall of said hookah stem; urging air from said hookah hose through said wet smoke conduit into said bottle interior to create positive bottle pressure;

directing said wetted tobacco smoke into a pressure-actuated check valve, co-planar with said bottle and in gaseous communication with said dry smoke conduit of said stem, with a wet smoke entry exposed to said bottle interior and adapted to selectively impede, during neutral and negative bottle pressure events, and allow, during positive bottle pressure events, gaseous communication from said wet smoke entry to a wet smoke intake peripherally positioned adjacent to said dry smoke conduit; and directing said wetted tobacco smoke upwardly through said dry smoke conduit toward and through said hookah burner.

* * * * *